US010486785B2

(12) United States Patent
Kray et al.

(10) Patent No.: US 10,486,785 B2
(45) Date of Patent: Nov. 26, 2019

(54) PROPELLER ASSEMBLY AND METHOD OF ASSEMBLING

(71) Applicant: General Electric Company, Schenectady, NY (US)

(72) Inventors: Nicholas Joseph Kray, Mason, OH (US); Peggy Lynn Baehmann, Glenville, NY (US); Stefaan Guido Van Nieuwenhove, Bavaria (DE)

(73) Assignee: General Electric Company, Schenectady, NY (US)

( * ) Notice: Subject to any disclaimer, the term of this patent is extended or adjusted under 35 U.S.C. 154(b) by 309 days.

(21) Appl. No.: 15/295,578

(22) Filed: Oct. 17, 2016

(65) Prior Publication Data

US 2018/0105244 A1 Apr. 19, 2018

(51) Int. Cl.

| | |
|---|---|
| ***B63H 1/20*** | (2006.01) |
| ***F01D 5/30*** | (2006.01) |
| *B63H 1/14* | (2006.01) |
| *B63H 1/26* | (2006.01) |

(52) U.S. Cl.

CPC ..... *B63H 1/20* (2013.01); *F01D 5/30* (2013.01); *B63H 1/14* (2013.01); *B63H 1/26* (2013.01)

(58) Field of Classification Search

CPC ..... B63H 1/20; B63H 1/14–265
USPC ..... 416/93 A, 244 B, 245 A, 247 A, 90 A
See application file for complete search history.

(56) References Cited

U.S. PATENT DOCUMENTS

| | | | | |
|---|---|---|---|---|
| 1,050,119 | A | 1/1913 | Flanders | |
| 4,466,776 | A | 8/1984 | Camboulives | |
| 4,930,987 | A | 6/1990 | Stahl | |
| 5,018,941 | A | 5/1991 | Heurtel et al. | |
| 5,256,035 | A | 10/1993 | Norris et al. | |
| 5,611,665 | A | 3/1997 | Angel | |
| 6,312,223 | B1 | 11/2001 | Samuelsson | |
| 6,537,031 | B1 | 3/2003 | Bacskay | |
| 8,235,666 | B2 * | 8/2012 | Rosenkranz | B63H 3/04 416/155 |
| 8,608,446 | B2 | 12/2013 | Pickens et al. | |

(Continued)

FOREIGN PATENT DOCUMENTS

| | | |
|---|---|---|
| EP | 2 261 113 A2 | 12/2010 |
| FR | 2 958 680 A1 | 10/2011 |

(Continued)

OTHER PUBLICATIONS

KR 20160052842—Original and translation.*

(Continued)

*Primary Examiner* — Carlos A Rivera
*Assistant Examiner* — Behnoush Haghighian
(74) *Attorney, Agent, or Firm* — Dority & Manning, P.A.

(57) ABSTRACT

A propeller assembly that includes a hub having an outer radial surface and a plurality of wedge retaining members removably coupled to the hub. The plurality of wedge retaining members are spaced circumferentially about the outer radial surface such that a dovetail slot is defined between adjacent wedge retaining members. The assembly also includes at least one propeller blade including a root portion having a dovetail profile. The root portion is coupled to the hub and positioned within the dovetail slot. The plurality of wedge retaining members are configured to restrict radial movement of the root portion within the dovetail slot.

20 Claims, 3 Drawing Sheets

(56) References Cited

U.S. PATENT DOCUMENTS

| | | | | |
|---|---|---|---|---|
| 8,851,852 | B2 | 10/2014 | Blatchford | |
| 9,039,378 | B2 | 5/2015 | Ulgen | |
| 9,051,845 | B2 | 6/2015 | Bommanakatte et al. | |
| 9,068,465 | B2 | 6/2015 | Keny et al. | |
| 2014/0079553 | A1* | 3/2014 | Ulgen ..... | B63H 1/20 416/204 R |

FOREIGN PATENT DOCUMENTS

| | | | | |
|---|---|---|---|---|
| GB | 761380 | A | | 11/1956 |
| JP | S59-26395 | A | | 2/1984 |
| JP | H 01162897 | | * | 11/1989 |
| KR | 2016-0052842 | A | | 5/2016 |
| WO | WO 2016/131877 | | * | 8/2016 |

OTHER PUBLICATIONS

JPS 5926395—Original and translation.*
EP 2261113—Original and translation.*
International Search Report and Written Opinion issued in connection with corresponding PCT Application No. PCT/US2017/51082 dated Nov. 21, 2017.

* cited by examiner

PROPELLER ASSEMBLY AND METHOD OF ASSEMBLING

BACKGROUND

The present disclosure relates generally to marine propulsion systems and, more specifically, to a blade retention system for use with a marine propeller assembly.

At least some known marine propulsion systems include a rotating propeller assembly driven by a power generation unit. The propeller assembly generally includes a central hub and a plurality of propeller blades extending from the central hub. In at least some known marine vessels, such as those capable of transcontinental voyages, the propeller assembly is relatively large having a diameter of several meters. In such assemblies, the weight of the propeller assembly is generally directly proportional to an amount of stress induced on a drive system of the marine propulsion system.

Recently, at least some known manufacturers have attempted to reduce the amount of stress induced on the drive system by reducing the weight of the propeller assembly, such as by introducing lightweight composite materials into the propeller assembly. For example, the propeller blades may be fabricated from composite material to reduce the weight of the propeller assembly. In at least some known propeller assemblies, the central hub and propeller blades are formed separately from each other and subsequently joined to form an integral structure. However, methods for joining propeller blades fabricated from traditional materials are typically unable to be utilized when joining propeller blades fabricated from composite material.

BRIEF DESCRIPTION

In one aspect, a propeller assembly is provided. The assembly includes a hub having an outer radial surface and a plurality of wedge retaining members removably coupled to the hub. The plurality of wedge retaining members are spaced circumferentially about the outer radial surface such that a dovetail slot is defined between adjacent wedge retaining members. The assembly also includes at least one propeller blade including a root portion having a dovetail profile. The root portion is coupled to the hub and positioned within the dovetail slot. The plurality of wedge retaining members are configured to restrict radial movement of the root portion within the dovetail slot.

In another aspect, a blade retention system for use with a marine propeller assembly is provided. The system includes a hub including an outer radial surface and a plurality of wedge retaining members removably coupled to the hub. The plurality of wedge retaining members are spaced circumferentially about the outer radial surface such that a dovetail slot is defined between adjacent wedge retaining members. The dovetail slot is configured to receive a root portion of a propeller blade, wherein the plurality of wedge retaining members are configured to restrict radial movement of the root portion within the dovetail slot.

In yet another aspect, a method of assembling a marine propeller assembly is provided. The method includes coupling a root portion of a propeller blade to an outer radial surface of a hub, the root portion having a dovetail profile. The method further includes positioning a first wedge retaining member and a second wedge retaining member on opposing sides of the root portion, and coupling the first wedge retaining member and the second wedge retaining member to the hub such that the first wedge retaining member and the second wedge retaining member are coupled to the root portion with an interference fit.

DRAWINGS

These and other features, aspects, and advantages of the present disclosure will become better understood when the following detailed description is read with reference to the accompanying drawings in which like characters represent like parts throughout the drawings, wherein.

Figure 1:
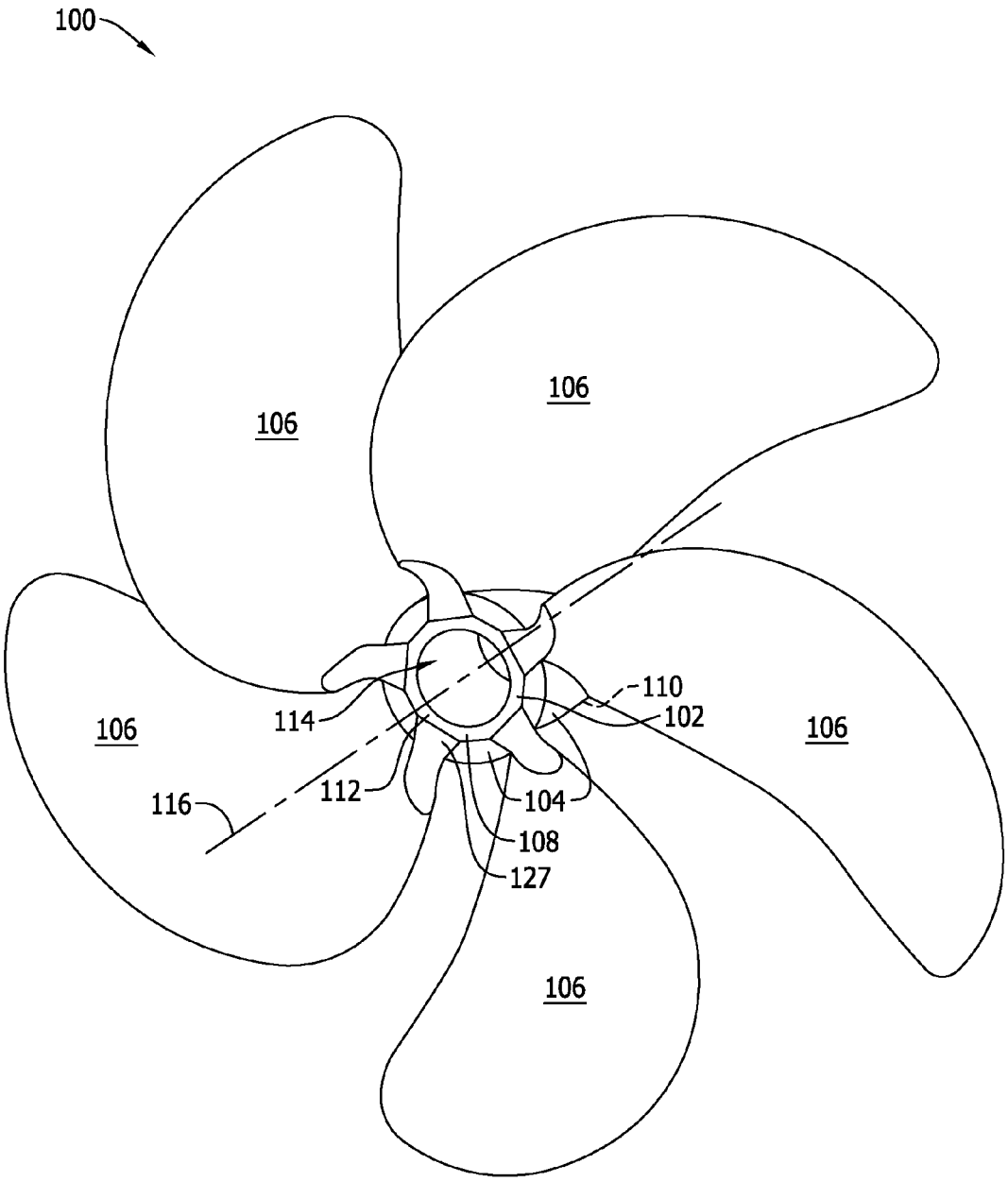
FIG. 1 is a perspective view of an exemplary marine propeller assembly.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged. Such ranges are identified and include all the sub-ranges contained therein unless context or language indicates otherwise.

As used herein, the terms "axial" and "axially" refer to directions and orientations that extend substantially parallel to a centerline of the propulsion shaft or the hub. Moreover, the terms "radial" and "radially" refer to directions and orientations that extend substantially perpendicular to the centerline of the propulsion shaft or the hub. In addition, as used herein, the terms "circumferential" and "circumferentially" refer to directions and orientations that extend arcuately about the centerline of the propulsion shaft or the hub.

Embodiments of the present disclosure relate to a blade retention system for use with a marine propeller assembly. More specifically, the system described herein includes a hub and a plurality of wedge retaining members removably coupled to the hub. The hub itself does not include retaining features for coupling a plurality of propeller blades thereto. Rather, a root portion of the propeller blades is formed with a dovetail profile, and each propeller blade is positioned between adjacent wedge retaining members. The wedge retaining members engage the root portion of the propeller blades, and are contoured such that radial movement of the propeller blades relative to the hub is restricted. For example, the wedge retaining members include tapered side walls that engage the root portion of the propeller blades with an interference fit when the wedge retaining members are coupled to the hub. As such, the hub design enables the hub to be manufactured in a faster and simplified manner. In addition, the blade retention system enables the use of lightweight propeller blades in the propeller assembly, thereby reducing the weight of the propeller assembly.

FIG. 1 is a perspective view of a marine propeller assembly 100. In the example embodiment, marine propeller assembly 100 includes a hub 102, a plurality of wedge retaining members 104 removably coupled to hub 102, and a plurality of propeller blades 106 coupled to hub 102. Hub 102 includes a first face 108, a second face 110 (not shown in FIG. 1, facing away from the view in FIG. 1), and a hub body 112 extending between first face 108 and second face 110. First face 108 and second face 110 are also referred to herein as "leading end" and "trailing end," respectively. In the example embodiment, first face 108 is spaced axially aft of second face 110. Hub body 112 further includes a central bore 114 that is axisymmetric with an axis of rotation 116 of marine propeller assembly 100.

Figure 2:
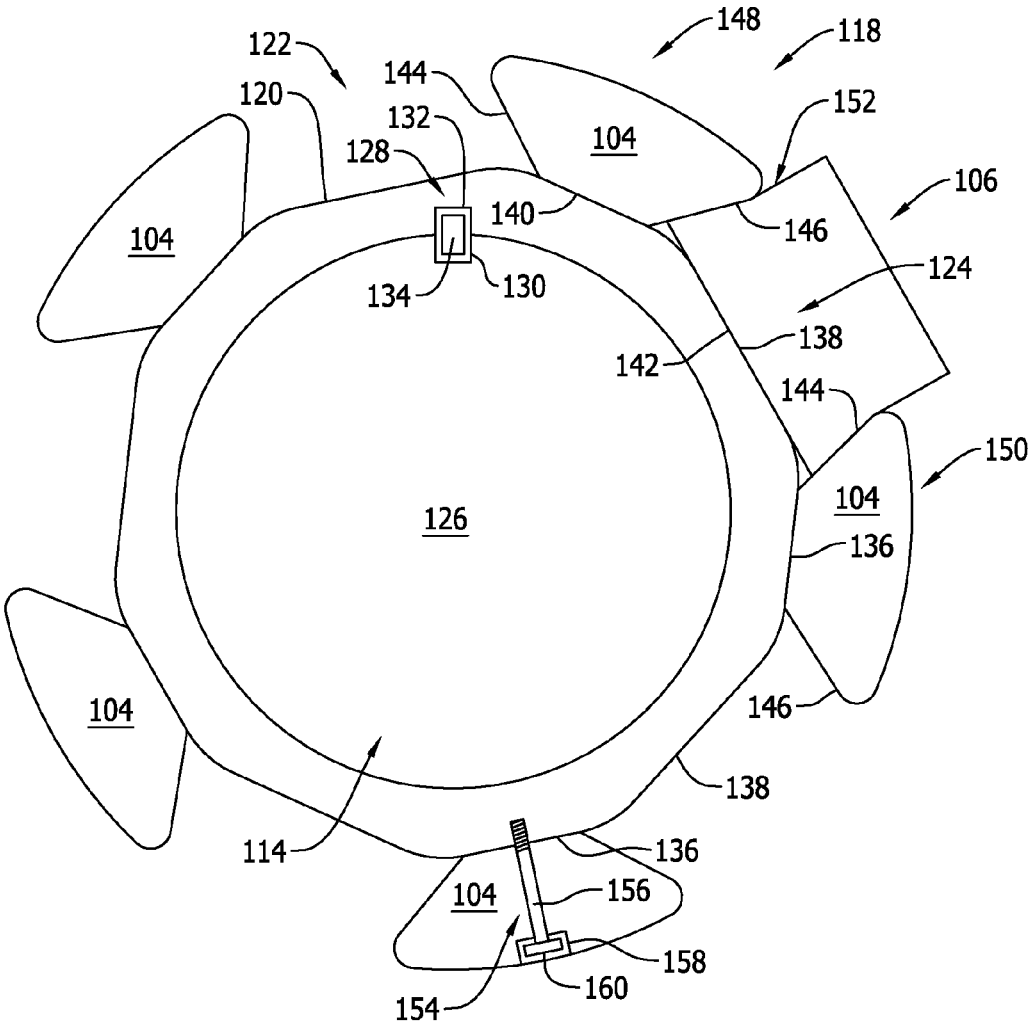
FIG. 2 is an axial view of an exemplary blade retention system that may be used in the marine propeller assembly shown in FIG. 1.
Figure 3:
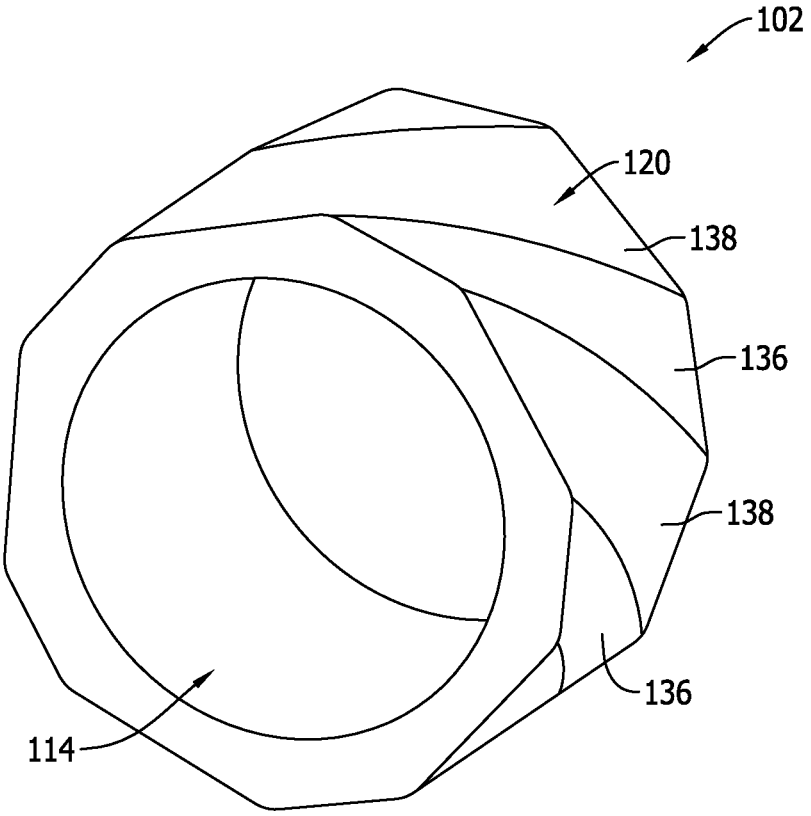
FIG. 3 is a perspective view of an exemplary hub that may be used in the blade retention system shown in FIG. 2.

FIG. 2 is an axial view of an exemplary blade retention system 118 that may be used in marine propeller assembly 100 (shown in FIG. 1), and FIG. 3 is a perspective view of hub 102 that may be used in blade retention system 118. In the example embodiment, hub 102 includes an outer radial surface 120, and the plurality of wedge retaining members 104 are spaced circumferentially about outer radial surface 120 such that a dovetail slot 122 is defined between adjacent wedge retaining members 104. As described above, at least one propeller blade 106 is also coupled to hub 102. Propeller blade 106 includes a root portion 124 having a dovetail cross-sectional profile, and root portion 124 is coupled to hub 102 and positioned within dovetail slot 122. As will be described in more detail below, wedge retaining members 104 restrict radial movement of root portion 124 within dovetail slot 122 when subjected to a centrifugal load, for example.

Hub 102 also includes central bore 114 sized to receive a propulsion shaft 126 therethrough. In some embodiments, hub 102 is coupled to propulsion shaft 126 with a keyed joint 128, for example. Keyed joint 128 includes a keyway 130, a keyseat 132, and a key 134. Keyed joint 128 facilitates restricting relative rotation between hub 102 and propulsion shaft 126, and facilitates torque transmission between hub 102 and propulsion shaft 126. Alternatively, hub 102 is coupled to propulsion shaft 126 with an interference fit, or with an axial spline joint.

In one embodiment, outer radial surface 120 of hub 102 includes a plurality of receiving surfaces oriented such that outer radial surface 120 has a polygonal cross-sectional profile. More specifically, the plurality of receiving surfaces include a plurality of first receiving surfaces 136 and a plurality of second receiving surfaces 138 alternatingly arranged with each other circumferentially relative to a centerline (i.e., axis of rotation 116 (shown in FIG. 1)) of hub 102. The plurality of first receiving surfaces 136 receive the plurality of wedge retaining members 104 and the plurality of second receiving surfaces 138 receive root portions 124 of propeller blades 106.

First receiving surfaces 136 and second receiving surfaces 138 are sized based on the size of the component coupled thereto. For example, each wedge retaining member 104 includes an inner radial surface 140 oriented for coupling to first receiving surfaces 136, and root portion 124 of propeller blade 106 includes an inner radial surface 142 oriented for coupling to second receiving surfaces 138. Inner radial surface 140 of wedge retaining member 104 has a smaller width than inner radial surface 142 of root portion 124. As such, correspondingly, first receiving surfaces 136 have a smaller width and a smaller surface area than second receiving surfaces 138 to facilitate substantially flush engagement between hub 102 and wedge retaining members 104, and between hub 102 and root portions 124 of propeller blades 106.

In addition, propeller blades 106 have a swept profile such that a leading edge and a trailing edge of root portion 124 are circumferentially offset from each other relative to the centerline of hub 102. As such, referring to FIG. 3, the plurality of receiving surfaces, such as first receiving surfaces 136 and second receiving surfaces 138, extend helically about outer radial surface 120 relative to the centerline of hub 102. Extending first receiving surfaces 136 and second receiving surfaces 138 helically about outer radial surface 120 facilitates maintaining flush engagement between hub 102 and root portions 124 of propeller blades 106 when extending between the leading end and the trailing end of hub body 112 (shown in FIG. 1). Similarly, the plurality of wedge retaining members 104 (shown in FIG. 2) are shaped for extending helically along first receiving surfaces 136 when coupled to hub 102. More specifically, wedge retaining members 104 are arcuately shaped circumferentially and radially relative to the centerline of hub 102 when coupled thereto. As such, wedge retaining members 104 are shaped to facilitate flush and secure engagement with root portions 124 when extending between the leading end and the trailing end of hub body 112.

Referring again to FIG. 2, each wedge retaining member 104 includes a first tapered side wall 144 and a second tapered side wall 146 that each extend from inner radial surface 142. As described above, wedge retaining members 104 are positioned circumferentially about outer radial surface 120, and dovetail slots 122 are defined between adjacent wedge retaining members 104. More specifically, first tapered side wall 144 at least partially defines a first dovetail slot and second tapered side wall 146 at least partially defines a second dovetail slot on an opposing side of each wedge retaining members 104 from the first dovetail slot. For example, in the example embodiment, wedge retaining members 104 include a first wedge retaining member 148 and a second wedge retaining member 150 positioned circumferentially adjacent to each other. Second tapered side wall 146 of first wedge retaining member 148 and first tapered side wall 144 of second wedge retaining member 150 define a dovetail slot 152, and root portion 124 of propeller blade 106 is positioned within dovetail slot 152.

In addition, wedge retaining members 104 include at least one bore hole 154 extending therethrough. Bore hole 154 is sized to receive a fastener 156 that couples the plurality of wedge retaining members 104 to hub 102. An example fastener 156 includes, but is not limited to, a threaded fastener, such as a bolt. In some embodiments, bore hole 154 includes a countersunk portion 158, and fastener 156 includes a head portion 160 received within countersunk portion 158. As such, head portion 160 is recessed to facilitate limiting its impact on flow field dynamics of fluid passing over wedge retaining members 104.

Moreover, fastener 156 facilitates preloading first wedge retaining member 148 and second wedge retaining member 150 against root portion 124 with a retaining force when coupling first wedge retaining member 148 and second wedge retaining member 150 to hub 102. For example, tightening fastener 156 increases the retaining force provided by first wedge retaining member 148 and second wedge retaining member 150. As such, first wedge retaining member 148 and second wedge retaining member 150 are coupled to root portion 124 of propeller blade 106 with an interference fit, thereby restricting radial movement of propeller blade 106 relative to hub 102.

An exemplary technical effect of the systems and methods described herein includes at least one of: (a) assembling a hub and blade assembly in a simplified manner; (b) reducing the weight of a marine propeller assembly; and (c) enabling the use of propeller blades manufactured from composite material in the marine propeller assembly.

Exemplary embodiments of a marine propeller assembly and related components are described above in detail. The system is not limited to the specific embodiments described herein, but rather, components of systems and/or steps of the methods may be utilized independently and separately from other components and/or steps described herein. For example, the configuration of components described herein may also be used in combination with other processes, and is not limited to practice with only turbofan assemblies and related methods as described herein. Rather, the exemplary embodiment can be implemented and utilized in connection with many applications where forming a hub and blade assembly in a simplified manner is desired.

Although specific features of various embodiments of the present disclosure may be shown in some drawings and not in others, this is for convenience only. In accordance with the principles of embodiments of the present disclosure, any feature of a drawing may be referenced and/or claimed in combination with any feature of any other drawing.

This written description uses examples to disclose the embodiments of the present disclosure, including the best mode, and also to enable any person skilled in the art to practice embodiments of the present disclosure, including making and using any devices or systems and performing any incorporated methods. The patentable scope of the embodiments described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A propeller assembly comprising:

a hub comprising an outer radial surface, said radial surface comprising a plurality of receiving surfaces including a plurality of first receiving surfaces and a plurality of second receiving surfaces alternatingly arranged with each other, wherein said plurality of first receiving surfaces have a smaller width than said plurality of second receiving surfaces;

a plurality of wedge retaining members, each wedge retaining member of the plurality of wedge retaining members including an inner radial surface, a first tapered side wall extending from the inner radial surface, and a second tapered sidewall extending from the inner radial surface, a distance between said first and second tapered sidewalls expanding as said first and second sidewalls extend from said inner radial surface, wherein said inner radially surface is removably coupled to said hub, said plurality of wedge retaining members spaced circumferentially about said outer radial surface such that a dovetail slot is defined between adjacent wedge retaining members; and at least one propeller blade comprising a root portion having a dovetail profile, said root portion coupled to said hub and positioned within said dovetail slot, wherein the first and second tapered sidewalls of said plurality of wedge retaining members are configured to engage said root portion with an interference fit such that said plurality of wedge retaining members restrict radial movement of said root portion within said dovetail slot.

2. The assembly in accordance with claim 1, wherein said plurality of receiving surfaces is oriented such that said outer radial surface has a polygonal cross-sectional profile.

3. The assembly in accordance with claim 2, wherein said plurality of receiving surfaces extend helically about said outer radial surface relative to a centerline of said hub.

4. The assembly in accordance with claim 3, wherein said plurality of wedge retaining members are arcuately shaped circumferentially and radially relative to said centerline of said hub when coupled to said hub such that said plurality of wedge retaining members are shaped for extending helically along said plurality of receiving surfaces when coupled to said hub.

5. The assembly in accordance with claim 2, wherein said plurality of first receiving surfaces is configured to receive said plurality of wedge retaining members and each second receiving surface of said plurality of second receiving surfaces is configured to receive said root portion of said at least one propeller blade.

6. The assembly in accordance with claim 5, wherein said plurality of first receiving surfaces have a smaller surface area than said plurality of second receiving surfaces.

7. The assembly in accordance with claim 1, wherein said first tapered side wall defines a first dovetail slot and said second tapered side wall defines a second dovetail slot, said first dovetail slot and said second dovetail slot defined on opposing sides of said each wedge retaining member.

8. The assembly in accordance with claim 1, wherein each wedge retaining member comprises a bore hole extending therethrough, said bore hole sized to receive a fastener configured to couple said plurality of wedge retaining members to said hub.

9. A propeller assembly, comprising:

a hub comprising an outer radial surface; and a plurality of wedge retaining members, each wedge retaining member of the plurality of wedge retaining members including an inner radial surface, a first tapered side wall extending from the inner radial surface, and a second tapered sidewall extending from the inner radial surface, a distance between said first and second tapered sidewalls expanding as said first and second sidewalls extend from said inner radial surface, wherein said inner radially surface is removably coupled to said hub, said plurality of wedge retaining members spaced circumferentially about said outer radial surface such that a dovetail slot is defined between adjacent wedge retaining members;

a plurality of propeller blades, each propeller blade of said plurality of propeller blades comprising a root portion having a dovetail profile, said root portion coupled to said hub and positioned within said dovetail slot, wherein the first and second tapered sidewalls of said plurality of wedge retaining members are configured to engage said root portion with an interference fit such that said plurality of wedge retaining members restrict radial movement of said root portion within said dovetail slot, wherein said plurality of propeller blades includes first propeller blade and a second propeller blade, wherein said plurality of wedge retaining members includes a first wedge retaining member, wherein said first wedge retaining member contacts said first propeller blade and said second propeller blade.

10. The system in accordance with claim 9, wherein said outer radial surface comprises plurality of receiving surfaces oriented such that said outer radial surface has a polygonal cross-sectional profile.

11. The system in accordance with claim 10, wherein said plurality of receiving surfaces extend helically about said outer radial surface relative to a centerline of said hub.

12. The system in accordance with claim 11, wherein said plurality of wedge retaining members are arcuately shaped circumferentially and radially relative to said centerline of said hub when coupled to said hub such that said plurality of wedge retaining members are shaped for extending helically along said plurality of receiving surfaces when coupled to said hub.

13. The system in accordance with claim 10, wherein said plurality of receiving surfaces comprises a plurality of first receiving surfaces and a plurality of second receiving surfaces alternatingly arranged with each other, said-plurality of first receiving surfaces is configured to receive said plurality of wedge retaining members and each second receiving surface of said plurality of second receiving surfaces is configured to receive said root portion of said propeller blade.

14. The system in accordance with claim 9, wherein said first tapered side wall defines a first dovetail slot and said second tapered side wall defines a second dovetail slot, said first dovetail slot and said second dovetail slot defined on opposing sides of said each wedge retaining member.

15. The system in accordance with claim 9, wherein each wedge retaining member comprises a bore hole extending therethrough, said bore hole sized to receive a fastener configured to couple said plurality of wedge retaining members to said hub.

16. A method of assembling a marine propeller assembly, said method comprising:

coupling a root portion of a propeller blade to a first receiving surface of a plurality of first receiving surfaces of an outer radial surface of a hub, the root portion having a dovetail profile;

positioning a first wedge retaining member and a second wedge retaining member on opposing sides of the root portion, the first wedge retaining member and second retaining member each including an inner radial surface, a first tapered side wall extending from the inner radial surface, and a second tapered sidewall extending from the inner radial surface, a distance between said first and second tapered sidewall expanding as said first and second sidewalls extend from said inner radial surface; and coupling the first wedge retaining member and the second wedge retaining member to second receiving surfaces of a plurality of second receiving surfaces of the outer radial surface of the hub, wherein said plurality of second receiving surfaces have a wider width than said plurality of first receiving surfaces, such that the first wedge retaining member and the second wedge retaining member are coupled to the root portion with an interference fit.

17. The method in accordance with claim 16 further comprising alternatingly arranging a plurality of propeller blades and a plurality of wedge retaining members about the outer radial surface of the hub.

18. The method in accordance with claim 16, wherein positioning a first wedge retaining member and a second wedge retaining member comprises orienting the first wedge retaining member and the second wedge retaining member for extending helically along the outer radial surface of the hub.

19. The method in accordance with claim 16, wherein coupling the first wedge retaining member and the second wedge retaining member comprises preloading the first wedge retaining member and the second wedge retaining member against the root portion with a retaining force.

20. The method in accordance with claim 16, wherein coupling the first wedge retaining member and the second wedge retaining member comprises coupling the first wedge retaining member and the second wedge retaining member to the hub with a fastener.

* * * * *